United States Patent [19]

Shelton et al.

[11] Patent Number: 4,483,045

[45] Date of Patent: Nov. 20, 1984

[54] SELF-CLEANING, SELF-CENTERING DOOR TRACK HAVING AN INTEGRAL MOUNT

[75] Inventors: Kenneth B. Shelton; Klaus H. Herkert; Lynn O. Twedt, all of Harvard, Ill.

[73] Assignee: Erect-A-Tube, Inc., Harvard, Ill.

[21] Appl. No.: 622,389

[22] Filed: Jun. 20, 1984

Related U.S. Application Data

[63] Continuation of Ser. No. 366,905, Apr. 9, 1982, abandoned.

[51] Int. Cl.[3] ..... E05D 13/02

[52] U.S. Cl. ..... 16/95 R; 16/96 R; 104/108

[58] Field of Search ..... 16/87.4 R, 87.4 W, 87.6 R, 16/87.6 W, 87.8, 95 R, 95 W, 95 D, 95 DW, 96 R, 96 D, 96 L, 102; 104/94, 107, 108, 109

[56] References Cited

U.S. PATENT DOCUMENTS

| | | | |
|---|---|---|---|
| 365,240 | 6/1887 | Coburn | 104/108 |
| 1,267,802 | 5/1918 | Phillips | 16/95 R |
| 2,715,966 | 8/1955 | Tieck | 104/108 X |
| 2,753,588 | 7/1956 | Grosh | 16/95 D |
| 2,889,572 | 6/1959 | Nawman | 16/95 R X |
| 3,197,817 | 8/1965 | Voris . | |
| 3,203,027 | 8/1965 | Ohman . | |
| 3,261,129 | 7/1966 | Brydolf et al. . | |
| 3,480,989 | 12/1969 | Edeus . | |
| 3,493,032 | 2/1970 | Brown, Jr. et al. . | |
| 3,636,588 | 1/1972 | Ferris | 16/94 |
| 3,661,431 | 5/1972 | Wisecarver | 308/6 R |
| 3,852,916 | 12/1974 | Laby | 49/409 |
| 3,974,777 | 8/1976 | Monne | 104/94 |
| 3,983,600 | 10/1976 | Smith | 16/87 R |
| 4,014,072 | 3/1977 | Schumacher | 16/95 R |
| 4,144,817 | 3/1979 | Morita | 104/108 |

FOREIGN PATENT DOCUMENTS

| | | | |
|---|---|---|---|
| 250235 | 4/1964 | Australia | 16/102 |
| 555572 | 3/1957 | Belgium | 16/95 D |
| 1900077 | 8/1970 | Fed. Rep. of Germany | 104/94 |
| 1334541 | 7/1963 | France | 16/95 R |
| 367847 | 2/1939 | Italy | 16/102 |

OTHER PUBLICATIONS

Frantz Manufacturing Company (Sterling, Ill.), Catalog No. 23, Hangers and Track Associated Hardware.

Chromalloy Farm Systems Division (Harvard, Ill.), Cannon Ball, [4 sets of pp.], Installation Data for Bolt Hung (bracketless) Track.

Price/Macemon, Inc., (Rochester, Minn.), Assembly Instructions for Twist-Loc Track System.

Lawrence Brothers, Inc., (Sterling, Ill.), Garage, Farm and Industrial Door Hardware, Catalog "g" 81.

Richards-Wilcox Manufacturing Company, (Aurora, Ill.), Door Hardware, Catalog A-400-R9, Copyright 1980.

Combo Corporation, (Walkerton, Ind.), The New Sliding Door Hardware [etc.].

Combo Corporation, (Walkerton, Ind.), Sliding Door Hardware, Price List No. 821, Effective Jan. 1, 1982.

National Manufacturing Co., (Sterling, Ill.), Prices Applying to Farm and Industrial Sliding Door Hardware, effective Apr. 13, 1981.

*Primary Examiner*—Fred Andrew Silverberg

*Attorney, Agent, or Firm*—Arnstein, Gluck, Lehr, Barron & Milligan

[57] ABSTRACT

A door track adapted for carrying a trolley supporting a door for rolling movement. The door track includes one or more single-piece track members having a first substantially planar surface and a pair of substantially identical spaced apart portions extending from the first substantially planar surface and forming a channel with the first planar surface. The spaced apart portions each have a substantially planar portion adjacent the first substantially planar surface to provide a plurality of flat mounting surfaces. The spaced apart portions further include inwardly curved portions extending from the substantially planar portions which are adapted to support a trolley for rolling movement therealong. The inwardly curved portions are spaced apart to freely receive a door supporting member which is secured to the trolley. The track member may also include lip portions extending outwardly from the curved portions, and the substantially planar portions may define fastener receiving openings for bracket-less mounting of the track member to a supporting surface. With this construction, a self-cleaning, self-centering door track having integral mounting structure is provided.

2 Claims, 4 Drawing Figures

SELF-CLEANING, SELF-CENTERING DOOR TRACK HAVING AN INTEGRAL MOUNT

This is a continuation of co-pending application Ser. No. 366,905 filed on Apr. 9, 1982, now abandoned.

BACKGROUND OF THE INVENTION

The present invention relates to doors which are moved along a track, and more particularly, to an improved track member for use with such doors.

Doors which are rolled across an opening to cover and uncover the opening have been widely used for applications such as fire doors, and for garages, barns and aircraft hangars and like buildings. Generally, the doors are secured to a rolling device such as a trolley, through an intermediate device, such as a door hanger. The trolley in turn is supported for rolling movement along a surface, frequently provided by a track. While track and trolley arrangements can be provided along both the top and bottom of the door and doorway, our invention is concerned primarily with door track arrangements provided along the top of the door and doorway for suspending the door for rolling movement.

Despite the wide application of rolling doors as heretofore described, several problems are frequently encountered and have remained unresolved. A number of these problems are due to the track which is utilized to support the trolley, and hence the door. The most commonly used track is square or rectangular in cross section, for example, box-shaped, with a longitudinal opening along its bottom side to permit a door hanger or other device to extend therethrough to secure the door to a trolley positioned within the track. The horizontal surfaces within the track which support the trolley frequently collect foreign matter, particularly dirt and dust, which may cause the door to operate erratically and often require excessive force to operate the door. Removal of foreign matter by hand is usually impossible without removal of the door and trolley as the clearance between the door and the track is usually insufficient to permit the insertion of a cleaning tool into the track. A second major problem with the box-shaped track is due to the propensity of the sides of the track to bend or buckle under load, frequently resulting in the trolley binding against the sides of the track. Another problem with this track is the freedom of the trolley to skew along the horizontal supporting surfaces of the track which may cause the door hanger or other supporting member to bind against one or both sides of the track opening.

As a means of removing the problems of the accumulation of foreign matter in the track and the failure of the box-like track to cause the trolley to roll along the center line of the tracks, attempts have been made to utilize round track, i.e. track which has a rounded or elliptical cross section. However, while round track eliminates some of the problems of box-shaped track, other problems are created. For example, round track is generally unstable upon installation and is susceptible to deformation, particularly twisting of the track from its installed position under the weight of the door suspended therefrom. Round track does not provide a surface which is readily usable for mounting the track to a supporting surface, such as a beam or building header, and therefore brackets, frequently of elaborate design, must be utilized to install the track. The relative instability of the round track and the need for brackets causes the installation to be more expensive, and also to increase the difficulty of the installation.

It has recently been proposed to utilize rounded track having an upper surface which is partially planar. However, the recently proposed track still does not resolve the problems encountered with round track, particularly the problems of deformation of the track under the weight of the door and the need for brackets or other devices to install the track, particularly where it is desired to secure the track to the vertical side of a beam or building header.

It is therefore an object of the present invention to provide a door track which takes full advantage of the many features provided by the prior-common box-shaped track while overcoming the difficulties encountered in the use of such track.

These and other objects, features and advantages of the present invention will become apparent from the following description when considered in connection with the accompanying drawings.

SUMMARY OF THE INVENTION

In general, the objects and advantages of the present invention are achieved by providing a single-piece track member adapted for carrying a trolley for supporting a door which has a unique configuration and combination of features. The track member includes a first portion which defines a substantially planar surface. Where the track member is utilized as an upper track from which a door is to be suspended, the first portion is preferably the upper portion of the track member and defines a substantially planar upper surface. The track member further includes a pair of substantially identical spaced apart second portions extending from the first portion and forming a channel with the first portion. The second portions preferably depend from opposite longitudinal side edges of the first or upper portion and define side portions of the track member. In the present invention the second portions each have substantially planar portions adjacent the first portion which extend generally from the said longitudinal edges of the first portion, and preferably are disposed generally perpendicularly with respect to the upper surface defined by the first or upper portion. The substantially planar portions herein described provide surfaces which are particularly adapted for fastening directly to a supporting surface such as a beam or building header, as will be hereinafter described.

The pair of substantially identical spaced apart second portions of the track member of the present invention each include inwardly curved portions extending from the substantially planar portions of the second portions and are spaced apart from the first portion. These inwardly curved portions each have a substantially identical radius of curvature and extend toward each other. By having the defined radii of curvature and being disposed toward each other, the inwardly curved portions of the track member are particularly adapted to support trolley means for centered rolling movement along the track member. Furthermore, by being inwardly curved, the track is substantially self-cleaning, that is, whenever foreign matter attempts to accumulate along the inside of the track member, the inwardly curved portions cause the matter to fall or roll by gravity toward the center of the track member and fall, again by gravity, through the opening of the track member defined by the spaced apart portions. Additionally, any foreign matter which may adhere to the inside of the track member along the path of the trolley is likely to be picked up by the trolley means passing therealong, and thrown from the trolley means to the track member and thereby be guided by the inner surface of the curved portions toward and into the opening therebetween.

The substantially identical radii of curvature of the inwardly curved portions causes the trolley means to be centered in the track member, while permitting the trolley means to be installed without regard to initially centering the same within the track. By having the inwardly curved portions in spaced apart relation, these portions freely receive a door supporting member, such as a door hanger which may be secured to the trolley means. The self-centering action of the inwardly curved portions of the track member of the present invention permit the trolley means to roll along the track member while being urged toward the center line of the track member, and to thereby provide rolling movement of the door virtually without any tendency for the trolley means or door supporting member, such as a door hanger, to bind against the track member during operation of the door.

A further feature of the present invention is the provision of outwardly extending lip portions extending from the inwardly curved portions of the track member. These lip portions, which also extend away from the first or upper portion of the track member provide a strengthening of the track member against deformation under load, particularly against the widening of the opening between the inwardly curved portions. The combination of the track member with the lip portions permit the use of a track member of relatively thin wall cross section as compared to track heretofore known. In the preferred embodiment of the present invention, the lip portions extend from the spaced apart inwardly curved portions of the track member at their closest spacing.

Additionally, at least one of the first portion and the pair of substantially planar portions of the spaced apart second portions define a plurality of fastener means receiving openings. Accordingly, through the use of fastener means passing through these openings, the track member of the present invention may be attached directly to a supporting surface, such as a beam or building header. Use of the fastener means openings of the track member in this manner eliminates the need for brackets between the track member and the supporting surface as commonly employed in the art. While fastener means receiving openings defined in the first or upper portion of the track member may be utilized to secure the track member directly to a supporting surface, it is preferred to provide a plurality of aligned fastener receiving openings in the pair of substantially planar portions of the second or side portions of the track member so as to permit securing the track member along at least one of its substantially planar portions of the second or side portions directly to a vertical supporting surface by insertion of fasteners therethrough without the need of any brackets therebetween.

With these features of construction, the track member of the present invention accomplishes the objects defined hereinabove.

DETAILED DESCRIPTION OF THE PREFERRED EMBODIMENT

Figure 1:
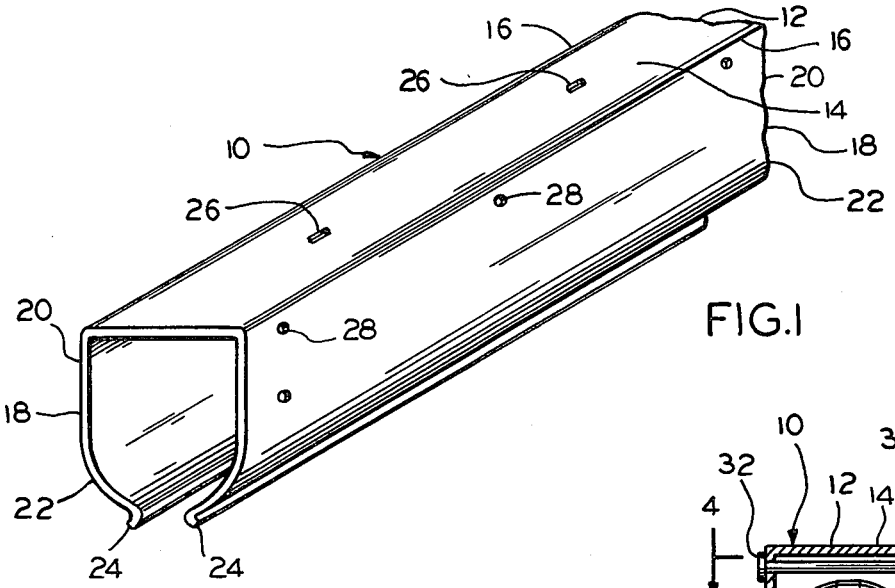
FIG. 1 is a perspective view of the track member in accordance with the present invention.

Referring to the drawings, the reference numeral 10 designates generally a track member in accordance with the present invention. Track member 10 is an integral member which includes a first portion 12 which defines a substantially planar surface 14 and a pair of longitudinally extending side edges 16. The substantially planar surface 14 comprises a longitudinally extending top wall adapted for co-planar abutment with a generally horizontal surface such as a beam of a building (not shown) and the longitudinally extending side edges 16 are preferably disposed in parallel opposed relation, as will be appreciated by referring to FIGS. 1 and 2. Extending from first portion 12, and generally from the side edges 16 defined by first portion 12 so as to be integral therewith, is a pair of substantially identical spaced apart second portions 18 which forms a channel with first portion 12. The second portions 18 comprise longitudinally extending side walls depending from each of the side edges 16 of the first portion 12, and the side walls 18 are identically shaped and oppositely facing, as will be appreciated by referring to FIGS. 1 and 3.

Figure 3:
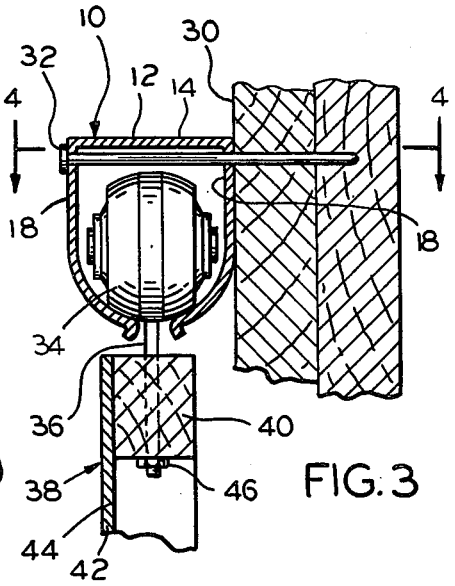
FIG. 3 is a cross-sectional view taken along lines 3—3 of FIG. 2.
Figure 4:
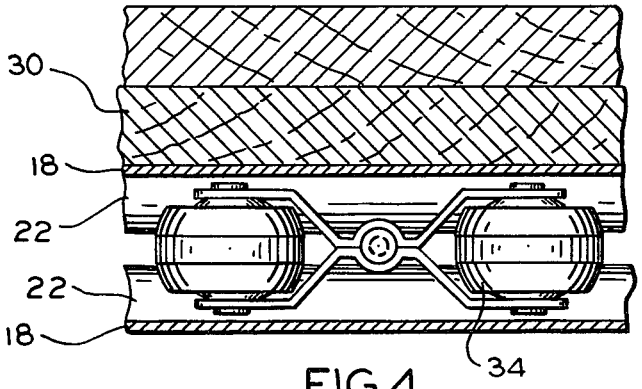
FIG. 4 is a cross-sectional view taken along lines 4—4 of FIG. 3.

Second portions 18 each have substantially planar upper portions 20 which are adjacent and integral with first portion 12 and extend generally perpendicularly from the longitudinal side edges 16 to a point generally intermediate the uppermost and lowermost extremes of the second portions 18, as shown in FIGS. 1 and 3. The planar upper portions 20 are adapted for coplanar abutment with a generally vertical surface such as a header 30 of a building, as shown in FIGS. 3 and 4. First portion 12 and substantially planar portions 20 provide surfaces which are particularly adapted for mounting in surface-to-surface contact with a supporting surface and for being fastened directly thereto, as will be hereinafter described.

Each of second portions 18 further includes a lower curved portion 22 which is integral with and extends from its substantially planar portion 20 so as to be disposed generally tangentially thereto, as shown in FIGS. 1 and 3. Curved portions 22 are spaced apart from first portion 12 and extend from the lowermost longitudinal portion of substantially planar portion 20. Curved portions 22 are inwardly curved, extend toward each other and have substantially identical radii of curvature which cause the track member to be generally symmetrical about its vertical center line i.e., the curved lower portions 22 of the second portions 18 each extend along a continuous downward and inward curve to a point of termination at the lowermost extreme of the second portions 18 (see FIG. 3). Curved portions 22 are spaced apart from each other so as to freely receive various means, such as door supporting means, as will be hereinafter described. With this construction, the door track 10 is self-cleaning by gravity and movement of a trolley 34 therein and is adapted for self-cleaning of the trolley 34 for non-binding rolling movement therealong (see FIGS. 3 and 4).

In the preferred embodiment, curved portions 22 include lip portions 24 which extend away from the first portion 12 and outwardly from the inwardly curved portions 22 and the space therebetween formed by the innermost edges of the curved portions. Lip portions 24 may extend a substantial distance outwardly from curved portions 22, but preferably only extend a short distance therefrom. Lip portions 24 provide a strengthening of track member 10 against deformation under load, particularly against the widening of the opening between the inwardly curved portions 22 at their closest spacing. Lip portions 24, as well as the other portions of track member 10 are integral with each other forming a single-piece track member in accordance with the present invention.

In the preferred embodiment, at least one of first portion 12 and the pair of substantially planar portions 20 of second portions 18 define a plurality of fastener receiving openings in the described portions. Thus, first portion 12 may define openings 26, which preferably are spaced apart from each other and are positioned generally along the center line of track member 10. Similarly, substantially planar portions 20 may define openings 28 which preferably are spaced apart from each other and are positioned in portions 20 in the area adjacent first portion 12. It is preferred that at least several, and most preferably all, of the openings formed in either one of planar portions 20 are aligned with corresponding openings formed in the other of substantially planar portions 20. In the most preferred embodiment, track member 10 includes both openings 26 defined in first portion 12 and aligned openings 28 defined in subtantially planar portions 20 to permit the track member 10 to be mounted directly to surfaces in contact with any of portions 12 or 20 by the use of fasteners as will be hereinafter described.

Figure 2:
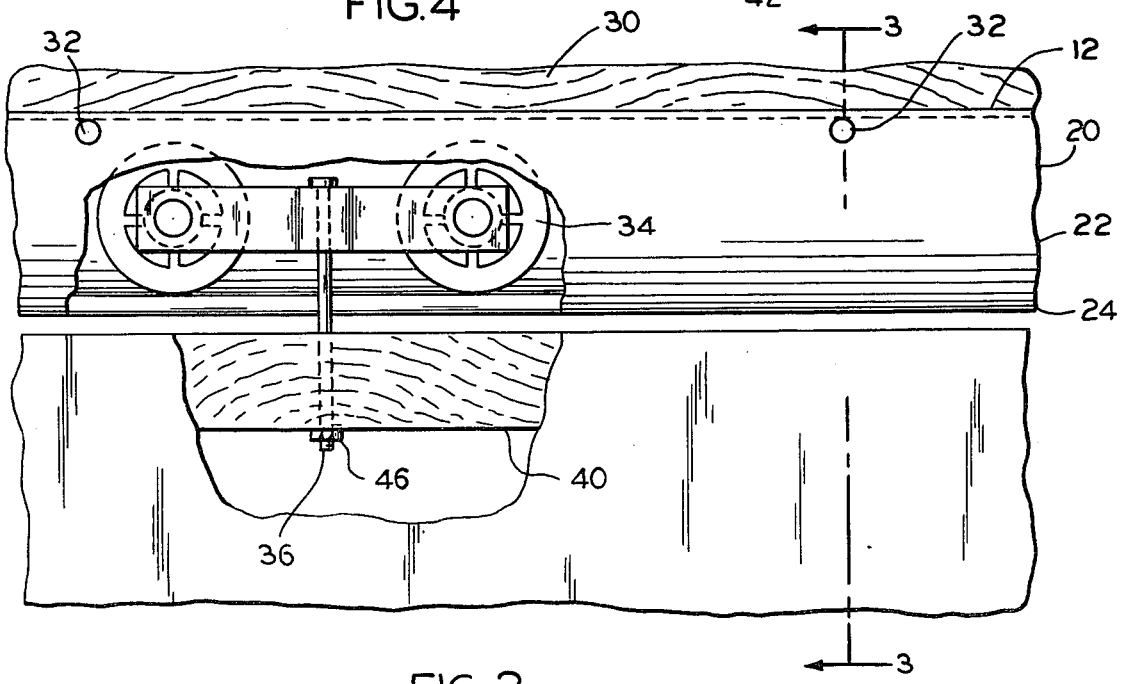
FIG. 2 is a front elevational view of the track member of FIG. 1 mounted on a building header and supporting a trolley and door, with the track member partially broken away.

Track member 10 can be utilized in various applications and may be installed as the bottom track for the operation of certain doors and may also be vertically installed for the operation of overhead-type doors. However, track member 10 is particularly adapted to be utilized as the overhead track for doors which are to be suspended from the track. Where track member 10 is to be utilized in the latter application, as best illustrated in FIGS. 2 and 3, first portion 12 can be described as an upper portion 12 defining a substantially planar upper surface 14 and the second portions 18 can be described as side portions 18 each depending from one of the opposite longitudinally extending side edges 16 of upper 12. In addition, substantially planar portions 20 can be described as substantially planar upper portions 20 which are disposed generally perpendicularly with respect to upper surface 14 defined by upper portion 12 and forming the channel therewith. Similarly, curved portions 22 can be described as depending from the lowermost longitudinal portions of upper portions 20 of side portions 18 and in spaced relation to upper portion 12. As the portions of the integral one-piece track member 10 are the same in such application as heretofore described, the same reference numerals have been utilized to describe the same portions.

As illustrated in FIGS. 2–4, when utilized as an upper track from which a door is to be suspended, track member 10 can be placed in surface-to-surface contact with a surface, for example, the vertical side of a building header 30 and mounted thereto by fastening means, for example, nails 32. Track member 10, which includes integral mounting means 26 and 28 associated with the longitudinally extending upper portion 12 and the longitudinally extending side portions 18, respectively (see FIG. 1), can be mounted to the bottom surface of a beam by contacting upper portion 12 thereagainst and inserting fastening means, such as threaded fasteners, for example, bolts (not shown), through one or more of the plurality of longitudinally spaced fastener-receiving openings 26 in the track member and causing the fasteners to hold the upper surface 12 against the supporting surface. As shown, track member 10 is preferably mounted by placing one of the substantially planar upper portions 20 of the side portions 18 against the surface, such as header 30, and driving fasteners, such as nails 32 through one or more of the longitudinally spaced fastener-receiving openings 28 into the surface, such as header 30 to secure the track member thereto. It will be appreciated that the fastener-receiving openings 28 in the side portions 18 comprise aligned pairs of apertures in the planar upper portions 20 adjacent the top wall 12 (see FIG. 3). Direct mounting of track member 10 to a surface such as header 30 in this manner provides substantial additional strengthening to track member 10. Through the use of the fastener, e.g. nail 32, passing through aligned apertures 28 into header 30, the fastener provides a clamping action of one side portion 18 to the other and against header 30 to counteract forces tending to deform the side portions away from each other. In addition, the substantial surface-to-surface contact between one of the substantially planar upper portions 20 and the surface of header 30 further prevents deformation of that side portion of track member 10. Furthermore, the presence of a fastener, such as nail 32, passing through track member 10 in an area adjacent to upper portion 12 provides strengthening of upper portion 12 against deformation of the upper portion so as to maintain substantially planar upper surface 14 in its substantially planar condition.

In the preferred embodiment, a trolley 34 is positioned within the channel formed in track member 10 for rolling movement along the inner surfaces of curved portions 22. Although trolley 34 may be of any design and may include completely spherical rollers, trolley 34 of the type shown can be advantageously used with track member 10. Secured to trolley 34 is a door hanger 36 which may be a bolt, which extends freely in the space formed between inwardly curved portions 22. Suspended on door hanger 36, and hence from trolley 34, is a door 38 which may include a frame member 40 and a surface member 42. In addition, the door will include vertical frame members 44 as partially shown. Door 38 can be secured to door hanger 36 by means of a nut 46 threaded onto hanger 36.

As briefly noted in the Summary of the Invention, the track member of the present invention with its inwardly curved portions of substantially identical radii of curvature causes trolley 34 to center itself approximately along the center line of track member 10 as it moves along the track member, and to center the door hanger 36 in the center of the space between the inwardly curved portions 22 so that the door, hanger and trolley will move along the track without the trolley or door hanger binding against the track. Furthermore, the inwardly curved portions of track member 10 provide a self-cleaning action by which foreign particles entering the track will fall by gravity and be guided by the inwardly curved portions toward the opening between the curved portions serving to expel such foreign particles from the interior of the track. Additionally, the trolley rolling along the inner surfaces of the inwardly curved portions of track member 10 will tend to dislodge any foreign matter resting on the inner surface of the curved portions facilitating the self-cleaning action.

It will be appreciated that the configuration of track member 10 with its substantially planar upper portions forming a channel with substantially perpendicular side portions, and its lower inwardly and curved portions advantageously provide a track which is structurally sound, resistant to deformation, particularly under the load of a door suspended therefrom and permits the use of materials of smaller cross-section than provided by track configurations heretofore known to the art. Furthermore, track member 10 with lip portions 24 extending outwardly from curved portions 22 provide additional strengthening of the curved portions so that track member is further reinforced against deformation of the curved portions which might otherwise occur due to the weight of door 38 suspended from trolley 34.

Various changes coming within the spirit of the present invention may suggest themselves to those skilled in the art. It will be understood that the invention is not to be limited to the specific embodiments shown and described or the uses mentioned, but the specific embodiments and uses are intended to be merely exemplary, the present invention being limited only by the scope of the appended claims.

We claim:

1. A door track for carrying a trolley supporting a door for rolling movement, comprising:

a longitudinally extending top wall having a pair of parallel opposed side edges, said top wall being adapted for coplanar abutment with a generally horizontal surface such as a beam of a building;

a longitudinally extending side wall depending from each of said side edges of said top wall, said side walls being identically shaped and oppositely facing, said side walls each including a planar upper portion joined to one of said side edges of said top wall so as to be disposed generally perpendicular thereto with said planar upper portions of said side walls extending to a point generally intermediate the uppermost and lowermost extremes of said side walls and being adapted for coplanar abutment with a generally vertical surface such as a header of a building, said side walls each also including a curved lower portion integral with the corresponding one of said planar upper portions so as to be disposed generally tangentially thereto with said curved lower portions of said side walls each extending along a continuous downward and inward curve to a point of termination at the lowermost extreme of said side walls and being adapted for self-centering of said trolley for non-binding rolling movement, said side walls being spaced apart at the lowermost extreme to define a longitudinally extending opening for freely receiving a door support of said trolley, said door track being self-cleaning by gravity and movement of said trolley; and integral mounting means associated with said longitudinally extending top wall and said longitudinally extending side walls, said mounting means associated with said top wall comprising a plurality of longitudinally spaced fastener-receiving openings, said mounting means associated with said side walls comprising a plurality of longitudinally spaced fastener-receiving openings, said fastener-receiving openings in said side walls comprising aligned pairs of apertures in said planar upper portions adjacent said top wall, whereby each of said aligned pairs of apertures in said sidewalls are adapted to have a single fastener extending therethrough.

2. The door track as defined by claim 1 wherein said curved lower portions of said side walls each include an outwardly turned lip portion at the lowermost extreme of said side walls.

* * * * *